US005672064A

United States Patent [19]

Provencher et al.

[11] Patent Number: 5,672,064

[45] Date of Patent: Sep. 30, 1997

[54] STIFFENER FOR ELECTRICAL CONNECTOR

[75] Inventors: Daniel B. Provencher, Weare, N.H.; Philip T. Stokoe, Attleboro, Mass.; David M. McNamara, Amherst, N.H.

[73] Assignee: Teradyne, Inc., Boston, Mass.

[21] Appl. No.: 576,028

[22] Filed: Dec. 21, 1995

[51] Int. Cl.[6] ..... H01R 9/09

[52] U.S. Cl. ..... 439/79; 439/608

[58] Field of Search ..... 439/608, 108, 439/79, 607

[56] References Cited

U.S. PATENT DOCUMENTS

| | | | |
|---|---|---|---|
| 4,655,518 | 4/1987 | Johnson et al. | 439/79 |
| 4,871,321 | 10/1989 | Johnson | 439/79 |
| 5,104,341 | 4/1992 | Gilissen et al. | 439/608 |
| 5,403,206 | 4/1995 | McNamara et al. | 439/79 |
| 5,484,310 | 1/1996 | McNamara et al. | 439/608 |

*Primary Examiner*—Gary F. Paumen
*Assistant Examiner*—Christopher Goins
*Attorney, Agent, or Firm*—Edmund J. Walsh

[57] ABSTRACT

A durable modular connector assembly, particularly for use as a daughter board connector. The connector is made up of connector modules organized on a stiffener. Each connector module includes an alignment block to frictionally engage contact tails. The stiffener is connected to both the base and the alignment block so that the resulting module is rigidly held together and to the stiffener. The connector is therefore less susceptible to damage.

9 Claims, 3 Drawing Sheets

*Fig. 2A.*
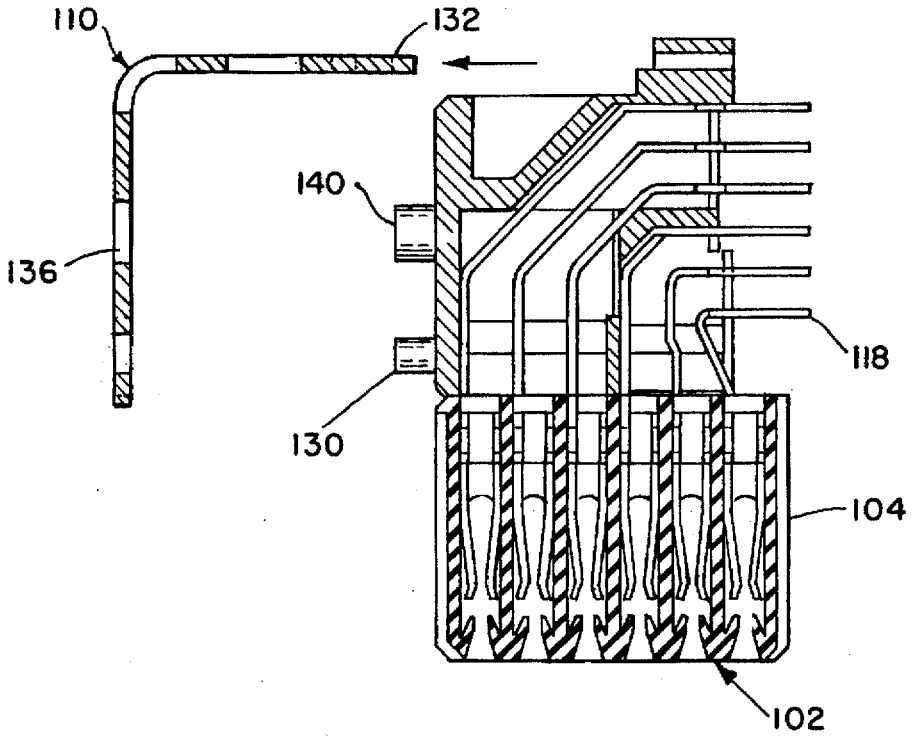
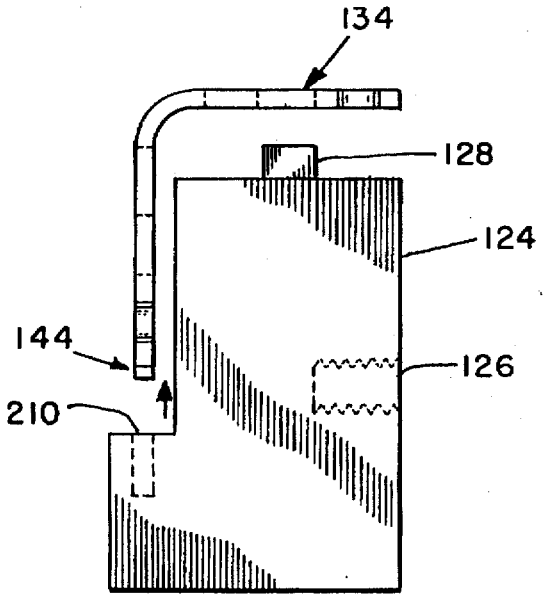
*Fig. 2B.*

STIFFENER FOR ELECTRICAL CONNECTOR

This invention relates generally to electrical connectors and more specifically to modular electrical connectors joined by a stiffener.

Connectors are widely used in electronic equipment. They route signals between electronic components on different printed circuit boards. A connector is usually made in two pieces. Each piece has a plastic housing with numerous contacts held in it. The pieces of the connector are shaped so that the two pieces can be plugged together. When plugged together, contacts in each housing touch, making an electrical path.

The contacts in each piece of the connector have tail portions extending from the housing. The tail portions are attached to printed circuit boards. In this way, signal paths are completed from one circuit board to another.

One difficulty in manufacturing connectors is that it is difficult to maintain proper tolerances in the plastic housing if the housing is large. If the tolerances are off by too much, the connector pieces can not be plugged together. To avoid this problem, Teradyne Connection systems of Nashua New Hampshire has been manufacturing modular connectors for many years. Other modular connectors are now commercially available.

Each module is relatively small. It is therefore easier to manufacture the connector modules with the proper tolerances. The modules are then held together on a metal "stiffener." Because it is easier to maintain proper tolerances in a metal part than a plastic part, the metal stiffener can easily provide accurate positioning of the modules.

Early modular connectors were screwed or riveted to the stiffener. Holes were drilled in the stiffener wherever a connector was to be mounted. In some instances, plastic features on the connector housing were pressed into the holes to hold the connector modules to the stiffener. This arrangement is difficult to manufacture because holes must be drilled in the stiffener to accommodate each unique combination of modules.

U.S. Pat. No. 4,655,518 to Johnson et al. illustrates such an arrangement, which is also illustrative of a product called HD PLUS, sold by Teradyne Connection Systems of Nashua, New Hampshire. That product includes an extruded aluminum stiffener which is extruded with a groove. The groove receives a screw, which holds the stiffener to the board. That connector included an alignment board to hold the contact tails in position. The contact board had plastic features on it which were inserted into the groove in the stiffener to hold the alignment board in place.

An extruded aluminum stiffener, while extremely rigid, is relatively expensive to manufacture. U.S. Pat. No. 5,403,206 to McNamara et al. (which is hereby incorporated by reference) shows an improved stiffener. The stiffener is stamped with a continuous pattern of holes and barbs. The stiffener is bent at a right angle so that the holes are on a surface intended to be mounted perpendicular to a printed circuit board and the barbs are on a surface parallel to the printed circuit board. The barbs are inserted into slots along the front edge of the connector modules. Mounting blocks are then inserted in the holes in the stiffener above the connector. In some instances, mounting blocks are alternatively mounted under the stiffener between connector modules. This alternative mounting makes the connector longer but not as wide.

To secure the connector to a printed circuit board, the mounting blocks are screwed to the board. The connector modules are firmly held to the board because contact tails from the connector are also secured to the board, such as by soldering.

It would be desirable if this arrangement could be made more durable. Durability is particularly important while the connector is being mounted to the circuit board. In the process of mounting the connectors to the board, the contact tails must be inserted through holes in the printed circuit board. There are numerous contact tails. A typical modular connector might have, for example, hundreds of contacts. The contact tails are arranged in a rectangular array with spacings of a few millimeters, or less, between adjacent contact tails. Therefore, even small deviations in the position of a contact tail can prevent the connector from aligning with the holes on the printed circuit board. This connector also included an alignment plate with a hole pattern matching the hole pattern on the printed circuit board. This plate aids in alignment, but still allows considerable movement of contact tails, particularly in a direction perpendicular to the printed circuit board while the contacts are being inserted into the board.

We have discovered that the durability of modular connectors can be improved by making changes to the stiffener and contact tail retention mechanism in accordance with our invention, as described below. In particular, we observed that some modular connectors were damaged upon insertion into printed circuit boards because the stiffener, though attached to the front of the connector with the barbs in slots, sometimes rotates away from the top of the connector. This rotation makes positioning of the connector difficult for insertion into the board, leading to misalignment and possibly bent contact tails. We also observed that some modular connectors were damaged on insertion because, when there is small misalignment between a contact tail and hole, the contact tail tends to get pushed through the plate and bent.

SUMMARY OF THE INVENTION

With the foregoing background in mind, it is an object of the invention to provide a more durable modular connector.

The foregoing and other objects are achieved in a modular connector system organized onto a stiffener. The stiffener has two surfaces, with holes in one surface and barbs on the other surface. Each connector module housing has slots adapted to receive the barbs on one surface and hubs adapted to be press fit into the holes in the stiffener. With this arrangement, the connector modules are held rigidly to the stiffener before mounting to the printed circuit board.

In one embodiment, the connector module includes one or more alignment blocks, securing the contact tails. The blocks also have hubs on them which engage other holes on the stiffener. The resulting connector, though built up from modular elements is very durable, even before it is attached to a printed circuit board.

BRIEF DESCRIPTION OF THE DRAWINGS

The invention will be better understood by reference to the following more detailed description and accompanying drawings in which

FIG. 2A is a cross sectional view of a modular connector assembly of the invention taken along the line 2A—2A of FIG. 1A;

FIG. 2B is a cross sectional view of a modular connector assembly of the invention taken along the line 2B—2B of FIG. 1A.

DESCRIPTION OF THE PREFERRED EMBODIMENT

Figure 1A:
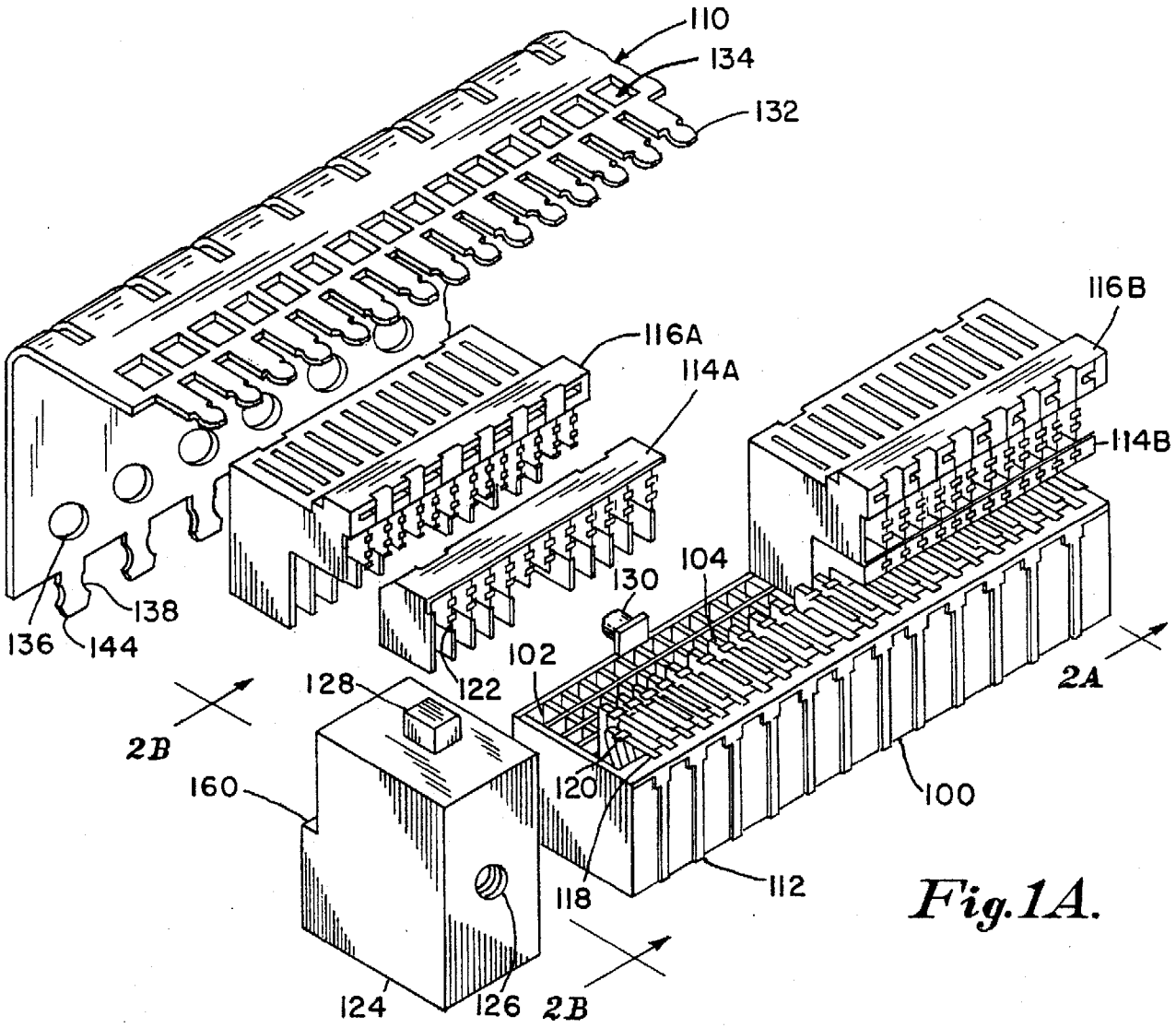
FIG. 1A is an exploded view of a modular connector according to the invention.

FIG. 1A shows an exploded view of a durable modular connector according to the invention. FIG. 1A shows that a module is made up of a base 100. Base 100 has a plurality of holes 102 into which contacts 104 are inserted. FIG. 1A shows that the holes are arranged in six rows, to form a six row connector. However, for clarity, only two rows of contacts are shown inserted in the housing.

In use, base 100 would likely be used to make what is sometimes referred to a "daughter board" connector. It would be mounted to a printed circuit board and plugged into another connector element also having a plurality of contacts, thereby making electrical connections. In a preferred embodiment, base 100 plugs into a standard pin header, which is sometimes called a "backplane connector" or a "motherboard connector". Base 100 is shown with alignment ribs 112, which are intended to aid the alignment contacts 104 with contacts one the pin header.

Contact tails 118 of contacts 104 extend from base 100 and are bent at generally a right angle to form a right angle connector. Multiple bends to form approximately a right angle might also be used as shown in the above referenced patent to McNamara et al. Each contact tail 118 has an enlarged shoulder portion 120, which is used to retain the contact tail as described below.

Associated with each modular connector base 100 are a plurality of alignment blocks 114A, 114B, 116A and 116B. These alignment blocks have slots 122 which engage the shoulder portions 120 of the contact tails 118. Once engaged, the alignment blocks 114A, 114B, 116A and 116B hold the contact tails 118 in position so that they are aligned with a hole pattern on a printed circuit board (not shown) to which the connector is to be attached. Alignment blocks 114A, 114B, 116A and 116B also prevent the contact tails 118 from being bent if pressure is placed on them when being inserted into a printed circuit board.

Preferably, shoulder portions 126 fit snugly into slots 122 so that they are held in place by friction. However, too many contact tails 118 are inserted into an alignment block at one time, the friction-will be too high. For that reason, the alignment block is made in pieces, each of which receives only a portion of the contacts and therefore requires limited force to install.

To manufacture the connector illustrated in FIG. 1A, contacts 104 (only some of which are shown in FIG. 1A for clarity) are inserted into the first three rows of holes 102. Alignment blocks 114A and 114B are then slid over the surface of base 100 with slots 122 receiving shoulders 120. The friction between shoulders 120 and slots 122 holds alignments blocks 114A and 114B in place.

Next, contacts 104 are inserted into the remaining three rows of holes 102 (which are not shown in FIG. 1A for clarity). In a like fashion, alignment blocks 116A and 116B are slid over the contact tails 118 of the contacts 104 in these rows and held in place by frictional engagement.

Base 100 as well as alignment blocks 114A, 114B, 116A and 116B are made of an insulative material. For example, plastic might be used. Preferably, these pieces are injection molded.

FIG. 1A shows a single base 100, representing only a single connector module. In use, it is likely that multiple connector modules would be lined up end to end to make a larger connector. Stiffener 110 is used to align these modules and make a rigid connector which operates as one large connector.

Stiffener 110 has several features which aid in the positioning and retention of the modular connector components. Stiffener 110 includes barbs 132, holes 134, holes 136 and projections 144 which are shaped to leave holes 138. These features repeat at periodic intervals. In the preferred embodiment, all of the features repeat with the same spacing. In the preferred embodiment, that spacing is approximately 3 mm.

Holes 138 are sized to engage hubs 130 on base 100. Holes 138 should be sized slightly smaller than hubs 130 to make a press fit attachment. There might be multiple hubs 130 on base 110. In a preferred embodiment, hubs 130 are spaced to be approximately 12 mm from each end of base 100. For longer connectors, additional hubs 130 are spaced approximately every 24 mm. Hubs 130 are injection molded as an integral part of base 100.

Barbs 132 are sized to fit in slots 142 on alignment blocks 116A and 116B. Slots 142 are formed in a projection (not numbered) on alignment blocks 116A and 116B. Barbs 132 Ere shaped with a wide head portion (not numbered) and a narrower neck portion (not numbered). Slots 142 have an inside dimension which is narrower than the width of the head portion of barbs 132. However, since alignment blocks 116A and 116B are made from a plastic type material, they will deform slightly to allow the head portion to be pressed into slot 142. However, that material will fill the neck portion to securely grip barb 132. In this way, barbs 132 will not pull out of slots 142 once inserted.

Holes 136 are sized to receive hubs 140 (FIG. 1B) on alignment blocks 116A and 116B. These elements are sized to make a press fit connection.

These structures hold the connector modules firmly to stiffener 110. The alignment blocks 116A and 116B are secured to stiffener 110 at an upper surface by barbs 132 in slots 142 and at a front surface by hubs 140 in holes 136. Thus alignment blocks 116A and 116B are prevented from rotating relative to stiffener 110. As alignment blocks 116A and 116B secure three rows of contact tails 118, those contact tails are securely held relative to stiffener 110.

Base 100 is prevented from rotating relative to stiffener 110 by the press fit connections into holes 136 and also because base 100 is securely attached to alignment blocks 116A and 116B. Contacts 104 tie base 100 to alignment blocks 116A and 116B. Further, alignment blocks 116A and 116B are held to base 100 by the surface of stiffener 110 containing holes 136 and 138.

Alignment blocks 114A and 114B are held in place because they fit into a cutout portion of alignment blocks 116A and 116B. Alignment blocks 114A and 114B are also tied to base 100 by contacts 104. Alignment blocks 114A and 114B therefore securely hold the remaining contact tails 118 relative to stiffener 110. Thus, the entire assembly is very rigid and the contact tails 118 are securely held in position. The result is a modular connector which is very durable and can be easily inserted into a printed circuit.

FIG. 1A also shows hold down module 124 mounted under stiffener 110. Hold down module 124 holds a modular connector to a printed Circuit board before tails 118 are soldered to the board. Hold down module 124 has a ledge 160 with a slot 210 (FIG. 2B) in it. Projections 144 on stiffener 110 are inserted into slot 210 (FIG. 2B) in the same way that barbs 132 are inserted into slots 142. Post 128 on the upper surface of hold down module 124 engages hole 134. Hold down module 124 has a hole 126 in it. Hole 126 is adapted to receive a screw. In use, a screw passing through a printed circuit board would be secured in hole 126, pulling the connector assembly toward the printed circuit board.

Figure 1B:
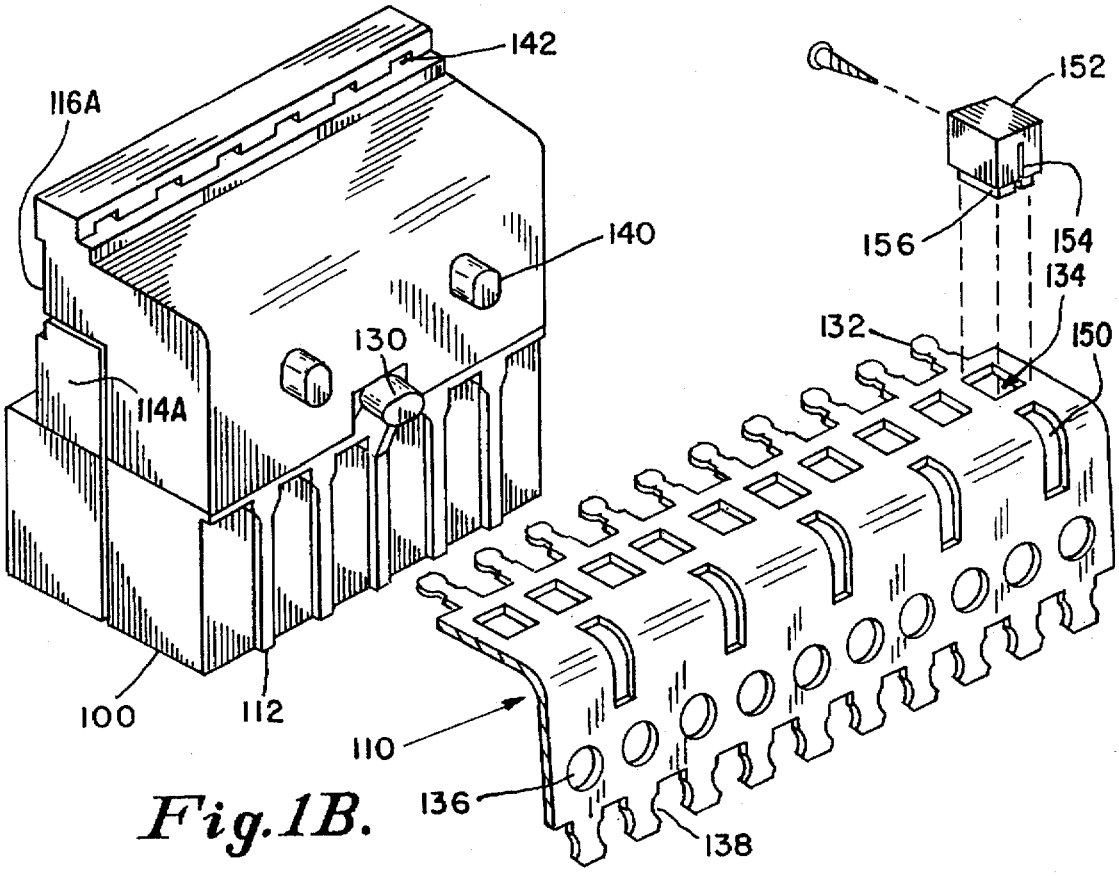
FIG. 1B is an alternative view of a modular connector according to the invention.

FIG. 1B shows an alternative view of a connector module. FIG. 1B also shows an alternative hold down module 152. Hold down module 152 is mounted above the stiffener 110. It has tab 156 which fit into rectangular holes 134. Hold down module contains a slit 154 partially through its thickness. Slit 156 passes through tab 156. When a screw, such as one passing through a printed circuit board, is inserted into hold down module 152, module 152 expands at the slit. Tab 156 therefore expands to securely hold the module to stiffener 110.

FIG. 2A shows a cross sectioned view of a modular connector according to the invention. It shows the direction of motion of a module relative to stiffener 110 to attach a module to stiffener 110. FIG. 2B shows that motion in an orthogonal direction is needed to attach hold down module 124 to stiffener 110.

Figure 3:
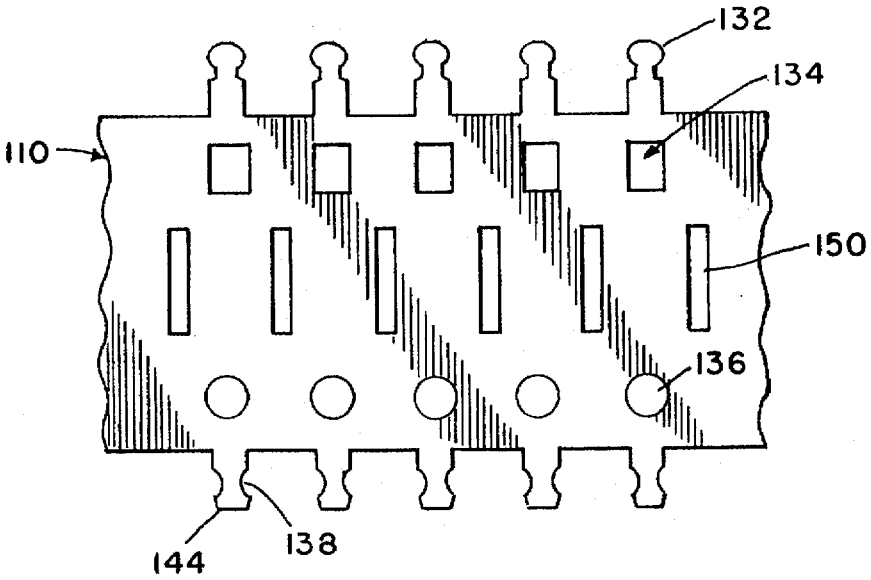
FIG. 3 is an illustration of the sheet used to make the stiffener shown in FIG. 1A.

Turning now to FIG. 3, the fabrication of stiffener 110 is shown. Stiffener 110 is stamped from a single sheet and then bent at a right angle. Holes 150 are stamped into the stiffener to provide stress relief in the bending process.

In use, it is intended that a blank as shown in FIG. 3 be formed from a long roll. To make a connector by assembling modules onto a stiffener, the desired length is cut from the roll and bent at a right angle. Multiple modules, such as those shown in FIGS. 1A and 1B are then attached to the stiffener. Hold down modules are also attached.

The modular connector organized on the stiffener is then attached to a printed circuit board with screws. The contact tails are then soldered. It is likely that the connector will be assembled at a different place than where it is mounted to a printed circuit board. However, the highly durable design of the invention ensures that the connector will not be damaged when ready to be installed on a printed circuit board.

Having described one embodiment, numerous alternative embodiments or variations might be made. For example, the use of alignment blocks 114 and 116 enable substantial force to be exerted on contact tails 118. It is therefore possible to use press fit contact tails rather than solder type contact tails.

Further, it should be appreciated that specific sizes and dimensions are given here only for purposes of illustration. For example, a six row connector is illustrated. Any size connector, such as a four or eight row connector, might be used.

Also, the preferred embodiment shows alignment blocks made in two pieces, such as 114A and 116A. A one piece alignment block might be used. However, in order to keep the insertion force reasonable, a one piece alignment block would need to have slightly larger slots 122 to reduce the friction between slots 122 and shoulders 120. Similarly, the alignment blocks could be made in three or more pieces.

Moreover, the invention was illustrated in relation to signal modules and hold down modules. Other types of modules might be used with the stiffener of the invention.

In addition, FIG. 1 shows only signal contacts inserted into housing 100. Shield contacts might also be inserted, similar to those shown in the above referenced patent to NcNamara et al.

Therefore, the invention should be limited only by the spirit and scope of the appended claims.

What is claimed is:

1. A modular connector assembly comprising:

a) a stiffener having a first surface and a second surface at a right angle with the first surface, the first surface having a first plurality of holes therethrough formed at evenly spaced intervals and the second surface including a plurality of projections formed at evenly spaced intervals; and b) a modular connector element comprising:

i) an insulative housing having at least one hub extending therefrom in a first direction, the hub extending into one of the first plurality of holes in the first surface of the stiffener;

ii) a plurality of slots having openings facing the first direction, with at least some of the plurality of projections from the second surface of the stiffener extending into the slots; and iii) a plurality of signal contacts running through the insulative housing.

2. A modular connector assembly comprising:

a) a stiffener having a first surface and a second surface at a right angle with the first surface, the stiffener having a first plurality of holes therethrough formed at evenly spaced intervals and the second surface including a plurality of projections formed at evenly spaced intervals; and b) a modular connector element comprising:

i) an insulative housing having at least one hub extending therefrom in a first direction, the hub extending into one of the first plurality of holes in the first surface of the stiffener; and ii) a plurality of slots having openings facing the first direction, with at least some of the plurality of projections from the second surface of the stiffener extending into the slots c) wherein the modular connector element comprises:

i) a base having a first surface with a plurality of holes therein, the base having the hub formed integrally therewith;

ii) a plurality of contact elements inserted into the holes in the base, each contact element having a tail portion extending from the base;

iii) an alignment block having a first surface resting on the first surface of the base, the alignment block having a plurality of slots frictionally engaging the tail portions of at least a portion of the contact elements, the alignment block having the plurality of slots formed therein.

3. The modular connector assembly of claim 2 wherein the alignment block comprises a projection perpendicular to the first surface of the alignment block with the slots formed in the projection.

4. The modular connector assembly of claim 2:

a) wherein the alignment block additionally comprises a hub integrally formed therein; and b) wherein the stiffener additionally comprises a second plurality of disposed at evenly spaced intervals in a line parallel to the first plurality of holes, with the hub of the alignment block inserted into one of the second plurality of holes.

5. The modular connector assembly of claim 2 wherein the alignment block comprises:

a) a first alignment block member with a first surface forming a portion of the first surface of the alignment block, the first alignment block having a second surface, perpendicular to the first surface with the slots formed therein;

b) a second alignment block member with a first surface forming a portion of the first surface of the alignment block and a second surface parallel with the second surface of the first alignment block member.

6. The modular connector assembly of claim 1 wherein:

a) the stiffener has a second plurality of holes formed at evenly spaced intervals therethrough, the second plurality of holes disposed in a line parallel with and offset from the first plurality of holes;

b) the modular connector element comprises at least a second hub extending therefrom in the first direction, the second hub extending into one of the second plurality of holes.

7. The modular connector element of claim 1:

a) wherein the first surface of the stiffener has a plurality of projections on the first surface, the projections having curved surfaces thereby defining said holes;

b) wherein the second surface of the stiffener has a plurality of holes formed therein; and c) additionally comprising a hold down module disposed next to the modular connector element and having a slot formed therein with one of the plurality of projections on the first surface inserted in the slot, the hold down module additionally comprising a projection extending one of the plurality of holes formed in the second surface.

8. A modular connector assembly comprising:

a) a stiffener having a first surface and a second surface, i) the first surface having a plurality of projections extending therefrom, the projections having sides such that adjacent projections form a hole therebetween, the first surface further having a second plurality of holes formed therethrough, ii) the second surface having a plurality of projections and a plurality of holes therethrough;

b) an insulative base having a first surface with a plurality of holes therein, the insulative based having a hub integrally formed therewith, the hub extending into a hole between adjacent projections on the first surface of the stiffener and frictionally engaging the inwardly curving sides of said projections;

c) a plurality of contact elements, each inserted into one of the plurality of holes in the first surface of the base and having tail portions extending from the base; and d) an alignment block having a first plurality of slots receiving and frictionally engaging tail portions of the contact elements, the alignment block having a hub integrally formed therewith, the hub being disposed in one of the second plurality of holes in the first surface of the stiffener, the alignment block further having a second plurality of slots receiving projections of the second surface of the stiffener.

9. The modular connector assembly of claim 8 wherein the alignment block has a first surface resting on the first surface of the base.

* * * * *